United States Patent [19]

Langdon

[11] 4,083,503

[45] Apr. 11, 1978

[54] PAPER STOCK ROTOR AXIAL POSITION CONTROLLING AND LOCKING DEVICE

[75] Inventor: Robert P. Langdon, Savoy, Mass.

[73] Assignee: Beloit Corporation, Beloit, Wis.

[21] Appl. No.: 731,049

[22] Filed: Oct. 8, 1976

[51] Int. Cl.[2] ..... B02C 7/00

[52] U.S. Cl. ..... 241/259.1; 241/244

[58] Field of Search ..... 241/244, 245, 248, 259.1, 241/259.2, 259.3; 408/129

[56] References Cited

U.S. PATENT DOCUMENTS

| | | | |
|---|---|---|---|
| 3,311,309 | 3/1967 | Cancilla | 241/30 |
| 3,884,592 | 5/1975 | Shulters | 408/129 |

FOREIGN PATENT DOCUMENTS

| | | | |
|---|---|---|---|
| 1,059,014 | 3/1954 | France | 241/259.1 |
| 72,068 | 12/1892 | Germany | 241/259.1 |

*Primary Examiner*—Gerald A. Dost

*Attorney, Agent, or Firm*—Hill, Gross, Simpson, Van Santen, Steadman, Chiara & Simpson

[57] ABSTRACT

A device for controlling the rotor in a paper stock refiner to locate the rotor in a neutral position in the stator during start-up and shut-down, at which time uneven stock flow and unequal hydraulic pressures may occur tending to move the rotor off floating center so that its refiner surfaces shift toward and possibly into damaging engagement with the stator refiner surfaces. During full operation the rotor shaft is released for normal self-centering or adjustment relative to the stator.

12 Claims, 3 Drawing Figures

PAPER STOCK ROTOR AXIAL POSITION CONTROLLING AND LOCKING DEVICE

The present invention relates to improvements in paper stock refiners, and is more particularly concerned with new and improved means for controlling the rotor in this type of apparatus during start-up and shut-down periods.

Stock refiners of the four disk type wherein two refining plates are attached to opposite sides of a rotating disk, and complementary refining plates are attached to a stator, are subject to the problem of uneven stock flow and unequal hydraulic pressures occuring during start-up and shut-down periods so that the rotor tends to shift toward the stator across the spaces between the refiner surfaces of the rotor and stator, and the confronting surfaces may actually contact resulting in excessive and uneven disk wear as well as excessive and annoying noise generation. Uneven disk wear causes temporary loss of proper surface and bar edge conditions of the disk resulting in poor stock treatment.

The described problem has been quite successfully alleviated by the method and apparatus covered in U.S. Pat. No. 3,311,309. According to the disclosure of that patent a force applying means in the form of a hydraulic or pneumatic expansible chamber is provided to apply an axial force to the rotor through its axially floating shaft to move it to a stop position against an adjustable preset stop which locates and locks the rotor at a neutral non-interferring position between the rotor and the stator during start-up or shut-down periods. The rotor shaft controlling device according to the patent is applied to one end of the shaft either outwardly beyond an internal drive motor, or at that end of the shaft which is adapted to be coupled to an external drive motor. Either of these arrangements requires substantial apparatus length at the outer end of the shaft to accommodate the device, thus creating a space problem where space is at a premium. A principal aim of the present invention is to alleviate the last mentioned problem, and to adapt the principles of the aforesaid patent to a more compact, economical simpler and efficient configuration and structural arrangement.

Accordingly, it is an object of the present invention to provide a new and improved apparatus for controlling the position of a paper stock refiner rotor during start-up and shut-down periods.

Another object of the invention is to provide a new and improved paper stock refiner rotor controlling device which is adapted to be installed in available space along the rotor shaft.

A further object of the invention is to provide a new and improved paper stock refiner rotor controlling device which is adapted to be installed in existing paper stock refiners.

Still another object of the invention is to provide a simple and rugged control device for the purpose indicated and which will function reliably with minimum attention.

According to features of the invention, there is provided in a paper stock refiner equipped with a rotary shaft supporting a rotor having oppositely facing refiner surfaces, a stator having refiner surfaces facing the rotor surfaces and defining with the rotor surfaces refining spaces in operation of the refiner, means for delivering stock to be refined into the spaces between the rotor and the stator surfaces, means for discharging the refined stock, and rotary supporting means for the shaft including a stationary bearing quill within which the shaft is axially and rotatably moveable in operation, the improvement of an actuator carried by the quill, and transmission means operative with the quill for transmitting axial moving force from the actuator to the shaft.

According to other features of the invention, axial force transmitting means are provided between the axially spaced bearings carried at axially fixed locations on the rotor shaft within a stationary bearing quill, and means on the quill for effecting operation of the axial force transmitting means to cause axial shifting movements of the shaft. A device for this purpose desirably comprises force transmitting element such as a sleeve mounted in non-rotary but conjointly axially moveable relation about the shaft within the quill and provided with a generally radially outwardly projecting arm extending through a clearance opening in the quill and means comprising an actuator on the outside of the quill adjacent to the opening and operable to actuate the arm in the axial direction of the shaft for thereby axially shifting the shaft in and relative to the quill.

Other objects, features and advantages of the invention will be readily apparent from the following description of certain representative embodiment thereof, taken in conjunction with the accompanying drawings although variations and modifications may be effected without departing from the spirit and scope of the novel concepts embodied in the disclosure and in which.

Figure 1:
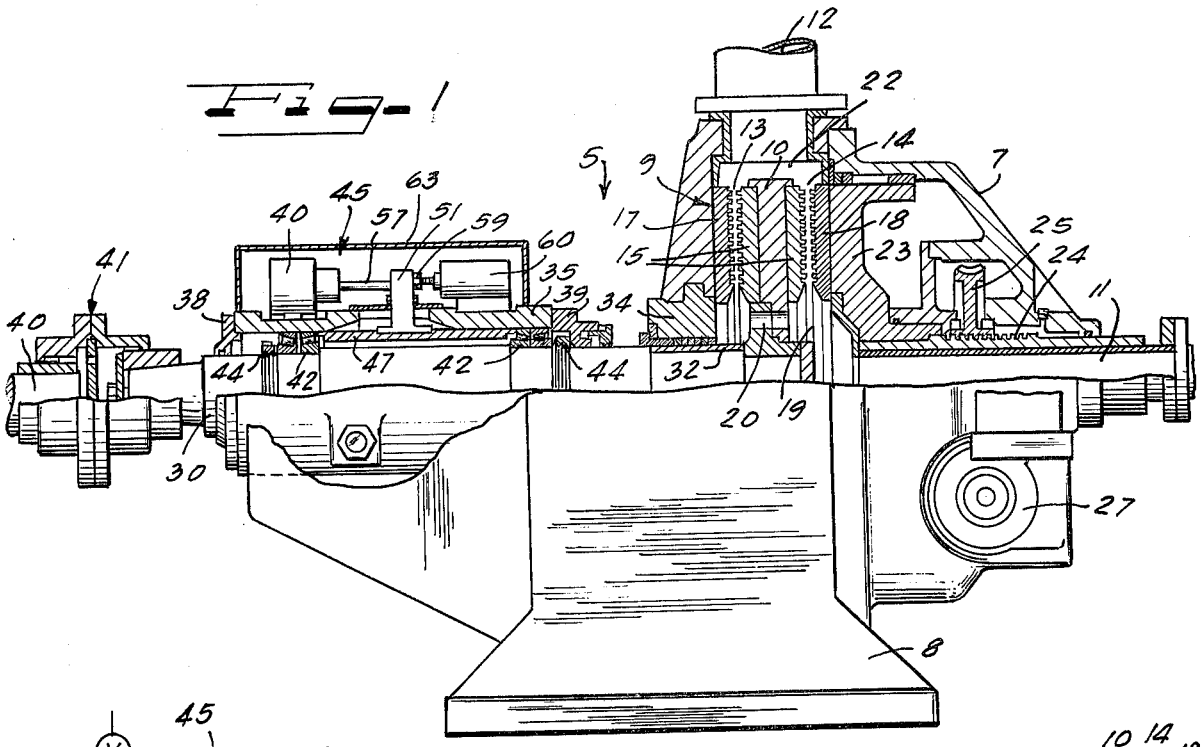
FIG. 1 is a side elevational view, partially in section, of a paper stock refiner embodying features of the invention.

A typical paper stock refiner 5 as shown in FIG. 1 and with which the present invention is especially adapted to be used comprises a housing 7 carried by a base 8 and provided therein with a stator 9, a rotor 10, a stock inlet 11 leading into the stator 9 and a refined stock outlet 12 leading from the stator.

Between the stator 9 and the rotor 10, radial annular refining spaces 13 and 14 are defined, refining of the stock being accomplished by means of refiner surfaces provided on the rotor 10 by means of annular disks 15 suitably mounted fixedly on the opposite sides of the generally disk-shaped rotor and facing toward complementary refiner disks 17 and 18 suitably fixedly mounted on the stator and having refiner surfaces facing toward and confronting the refiner surfaces on the rotor disks 15. Liquid carrying paper stock entering through the inlet 11 flows into an annular inlet chamber 19 at the hub of the rotor 10 and through cross passages 20 traversing the rotor hub so that in operation substantially equal volume of stock to be refined will enter at the radially inner sides of the refiner passages 13 and 14, undergoing refinement therein and then passing out into an outer annular receiving space 22 in the refining cavity within the stator and from thence to and through the outlet 12.

For adjusting the refining space one of the stator disks, herein the disk 18 is mounted to be axially adjustable and for this purpose is carried on a sliding head 23 to which is fixedly attached an adjusting screw 24 with which a worm gear 25 meshes and is adapted to be rotatably driven for effecting disk adjustment by means of a disk adjusting gear motor 27 and/or manual adjustment means. The motor 27 may by automatically operated such as by control mechanism which operates responsive to other functions or conditions in the refiner, and a stock characteristic sensing device may operate the motor for obtaining a predetermined output of the refiner and the axial position of the non-rotating stator refiner plate 18 is set in accordance with an automatic control signal. Since the rotor 10 is axially floating, as is customary in this type of refiner, the rotor 10 will automatically adjust by shifting axially in accordance with the hydraulic pressures acting on the faces of the refiner disks 15 as effected by the flow of stock through the refiner spaces 13 and 14 between the refiner disks.

In the refiner apparatus illustrated, the body disk of the rotor 10 is secured as by means of bolts 28 to a hub 29 which is retained on the inner end of an axially floating shaft 30 by means such as a hub retainer 31 removably fixed to the end of the shaft as by means of a cap screw 32. Adjacent to the hub 29, the shaft carries a sleeve 33 which may be formed from ceramic, and extends slidably through a packing box 34.

Outwardly relative to the packing box 34, the shaft 30 extends through a tubular bearing quill 35 fixedly carried by the base 8 and defining about the enclosed portion of the shaft a lubricating oil reservoir 37, the opposite ends of which are closed by means of oil seal end covers 38 and 39. A suitably capped filler opening 11*a* is provided on one side of the quill 35 and an oil sight gauge 11*b* may also be provided. An outer end portion of the shaft 30 is adapted to be coupled to a motor driven drive shaft 40 by means of a suitable slide coupling 41.

Within the quill 35, the shaft 30 is rotatably and axially moveably supported by means of axially spaced bearings 42 which are desirably in the form of roller bearing assemblies the inner races of which are retained in fixed axial position on the shaft 30 against respective annular shoulders 42 by means of lock washer nuts 44.

Conveniently, means for controlling the rotor 10 against undesirable axial deflection due to uneven stock flow and unequal hydraulic pressures during start-up and shut-down periods are in the form of a device 45 associated with the shaft 30 at the quill 35, thus not requiring any additional axial space nor adding any extension to the refiner 5 to attain the desired control. In one desirable form, the device 45 comprises force transmitting means operative within the quill 35 and efficiently in the form of a sleeve 47 coupled to the shaft 30 in non-rotary but conjointly axially moveable relation about the shaft between the bearings 42. In a preferred form, the sleeve 47 is in slidable engagement with the radially inwardly facing axially extending bearing surface 35*a* of the quill 35 and has opposite ends 48 in firm thrusting engagement with shoulders provided by the outer races of the bearings 42 and which races are in axially slidable non-rotary engagement with the inner cylindrical bearing surface of the quill 35. For efficient lubrication, the force transmitting sleeve 47 is provided with oil passage holes 49 so that lubricating oil can freely pass therethrough from the reservoir 37.

For applying axial force to the transmitting means sleeve 47 to cause axial shifting movements of the shaft, the device 45 comprises means on the quill 35 in the form of an actuator 50, and the sleeve 47 has an arm 51 which projects generally radially outwardly through a clearance opening 52 in the quill 35. In a preferred form, the arm 51 comprises a member having base flanges 53 secured as by means of screws 54 to the sleeve 47, and the opening 52 comprises an axially elongaged slot which is of ample length for any desired range of movement of the arm 51 and has opposite sides of a width to retain the arm 51 in slidable engagement permitting free axial movement with the shaft 30 but holding the arm and thereby the sleeve against rotary movement. A cover plate 55 carried by the arm 51 provides a slidable closure for the opening 52.

Conveniently the actuator 50 comprises a single acting fluid pressure motivated piston and cylinder unit secured in position on the outside of the quill 35 with a reciprocable plunger 57 aligned with the arm 51 to permit operation of the plunger to drive the arm in one axial direction, in the illustrated instance toward the rotor 10. Motivating fluid is adapted to be supplied through a suitably controlled supply line 58 connected to a source of pressure fluid which may be hydraulic, but may conveniently comprise mill air pressure. The fluid pressure is supplied to the actuator 50 during start-up and shut-down periods but is vented during normal operation of the refiner 5.

Figure 2:
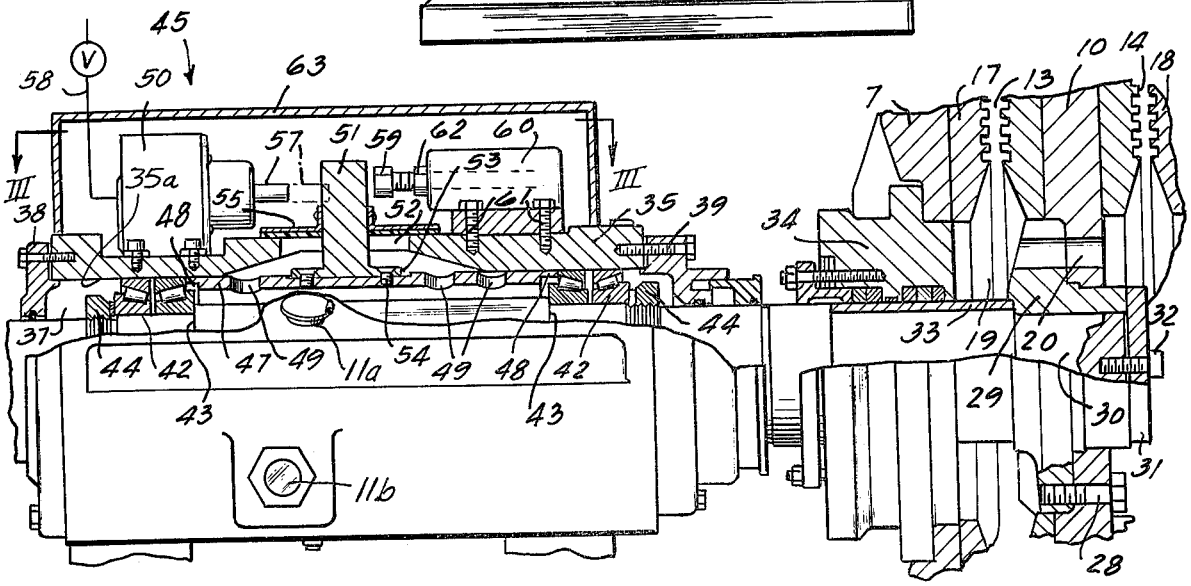
FIG. 2 is a fragmentary enlarged sectional elevational view showing in enlarged detail the relationship of the shaft controlling device of the invention as applied to the refiner apparatus.

In order to define the axial limit of movement of the shaft 30 during operation of the actuator 50, stop means comprising a bolt 59 are mounted on the quill 35 on the opposite side of the arm 51 from the actuator 50. In a desirable form the stop bolt 59 is threaded adjustably into a body block 60 secured to the quill as by means of bolts 61. After proper adjustment of the stop bolt 59 has been effected, it is locked by means of a locknut 62. Such adjustment of the stop bolt 59 is determined to stop axial movement of the shaft 30 as effected by projection of the actuator plunger 57 from a non-operating position as exemplified in full outline in FIG. 2 to the full thrust position against the arm 51 as exemplified in dash outline in FIG. 2 and in full outline in FIG. 1. In the full thrust position of the plunger 57, the arm 51 is driven against the stop 59 wherein the rotor 10 is, in effect, locked in substantially neutral position between the opposed refiner surfaces of the stator refiner disks 17 and 18. In the neutralizing action involving operation of the actuator 50, the rotor shaft 30 is caused to shift possibly only by small axial increment, but enough to drive the arm 51 firmly against the stop 59. Thereby axial shifting of the shaft and thereby the rotor during start-up and shut-down periods and possible damaging contact of the opposed refiner surfaces of the rotor and stator is effectively avoided. During normal running operation wherein the hydraulic pressure in the refining spaces 13 and 14 is substantially equalized, the actuator 50 is placed in non-operating condition, so that the shaft 30 can shift freely axially with floating of the rotor 10 in optimum substantially central refining action position between the refiner surfaces of the stator plates 17 and 18.

Figure 3:
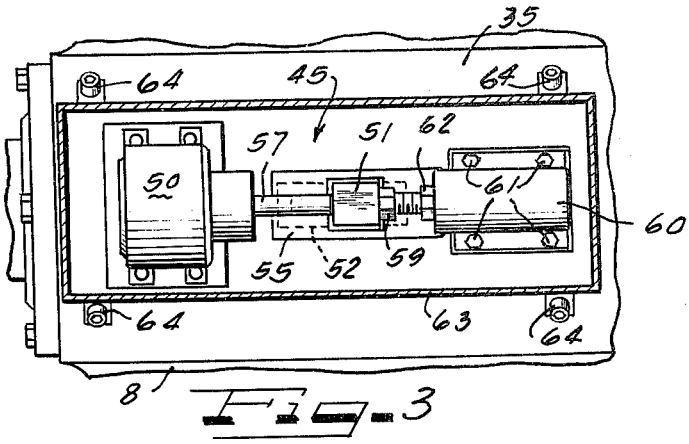
FIG. 3 is a top sectional plan view taken substantially along the line III—III of FIG. 2.

Once the device 45, and more particularly the stop 59 has been adjusted to attain substantially optimum rotor neutralizing results thru operation of the actuator 50, a protective enclosure hood 63 may be placed over the device 45 and attached to the quill 35 removably as by means of cap screws 64 (FIG. 3).

From the foregoing it will be apparent that the present invention provides a simple, low cost device for neutralizing the rotor during intervals such as start-up and shut-down when the refiner surfaces of the floating rotor might collide with the refiner surfaces of the stator. No thrust bearings are needed for the rotor shaft. The rotor may be of minimum length, consistent with well balanced bearing support. Power input for operating device is quite modest because an efficient small actuator will provide adequate rotor locking thrust to the force transmission arm of the device.

It will be understood that variations and modifications may be effected without departing from the spirit and scope of the novel concepts of this invention.

I claim as my invention:

1. In a paper stock refiner equipped with a rotary shaft supporting a rotor having oppositely facing refiner surfaces, a stator having refiner surfaces facing said rotor surfaces and defining with the rotor surfaces refining spaces in operation of the refiner, means for delivering stock to be refined into the spaces between the rotor and the stator surfaces, means for discharging the refined stock, and supporting means for the shaft including a stationary bearing quill within which the shaft is axially and rotatably movable in operation, the improvement comprising:

an actuator carried by the quill;

the quill having an axially extending and radially inwardly facing inner bearing surface;

axially spaced bearing assemblies on said shaft having inner races fixed for axial movement with the shaft and the assemblies having outer races in axially slidable bearing engagement with said inner bearing surface of the quill;

and transmission means for transmitting axial force from said actuator to said shaft comprising an axially extending member located between and engaged with axially facing shoulders on said outer bearing races.

2. A paper stock refiner having the improvement of claim 1, wherein said transmission means member comprises a sleeve axially moveably but non-rotatably mounted within the quill and having a generally radially extending arm, the quill having a clearance and guide slot through which the arm projects, and said actuator comprises a unit mounted on the outside of the quill and having means for operatively engaging the arm.

3. A paper stock refiner having the improvement according to claim 1, wherein said actuator comprises a pressure operated unit having a plunger acting upon one side of said arm, a stop mounted on said quill and opposing the opposite side of said arm, said plunger being adapted to be driven against the arm by the actuator to thrust the arm against said stop so that the force transmission sleeve will act through said bearings to hold the shaft in a position to maintain the rotor in a neutral position having regard to the refining spaces between the refiner surfaces of the rotor and the stator.

4. In a paper stock refiner equipped with a rotary shaft supporting a rotor having oppositely facing refiner surfaces, a stator having refiner surfaces facing said rotor surfaces and defining with the rotor surfaces refining spaces in operation, means for delivering stock to be refined into the spaces between the rotor and the stator surfaces, means for discharging the refined stock, and supporting means for the shaft including axially spaced bearings carried at axially fixed locations on said shaft, and a stationary bearing quill within which the shaft is axially and rotatably movable on said bearings in operation, the improvement comprising:

said quill having an axially extending and radially inwardly facing bearing surface and said bearings being in axially movable engagement with said bearing surface;

said bearings having races providing axially facing shoulders;

an axial force transmitting member between said bearings in engagement with said axially facing shoulders;

and means on the quill for effecting operation of said axial force transmitting member to act on said bearing races through said shoulders to cause axial shifting movements of the shaft.

5. In a paper stock refiner having the improvement according to claim 4, said force transmitting member comprising a sleeve member disposed about the shaft and an arm projecting through an opening in the quill and operable by said operation effecting means.

6. A paper stock refiner having the improvement of claim 4, wherein said force transmitting means comprise a pressure fluid actuator having means for driving said arm.

7. A paper stock refiner having the improvement of claim 6, including a stop mounted on said quill and against which said actuator means drives the arm and in which position the arm maintains the shaft through side member in a position wherein the shaft maintains the rotor in a substantially neutral position between the refiner surfaces of the rotor.

8. In a paper stock refiner equipped with a rotary shaft supporting a rotor having oppositely facing refiner surfaces, a stator having refiner surfaces facing said rotor surfaces and defining with the rotor surfaces refining spaces in operation, means for delivering stock to be refined into the spaces between the rotor and stator surfaces, means for discharging the refined stock, and supporting means for the shaft including a stationary bearing quill within which the shaft is axially and rotatably movable in operation, the improvement comprising:

said quill having an axially extending radially inwardly facing bearing surface;

an axial position controlling member for the shaft within the quill and in bearing engagement with said bearing surface in non-rotary relation to but conjointly axially movable with the shaft;

said position controlling member having a generally radially outwardly projecting arm;

a clearance opening in said quill through which said arm projects; means on the outside of said quill adjacent to said opening for actuating said arm in the axial direction of the shaft for thereby axially shifting the shaft in and relative to the quill;

said shaft carrying spaced bearings which are axially fixed on the shaft and engage in axially movable bearing relation with said bearing surface and thereby support the shaft rotatably in the quill;

and said axial position controlling member engaging said bearings and thereby shifting said shaft responsive to actuations of said arm by said actuating means.

9. A paper stock refiner having the improvement of claim 8, wherein said means on the outside of said quill comprise a pressure fluid operated actuator having a plunger engaging said arm.

10. A paper stock refiner having the improvement of claim 9, including a stop mounted on said quill adjacent to the opening at the opposite side of said arm from said actuator and against which the actuator drives the arm to position the shaft in a neutral orientation of the rotor within the stator.

11. A paper stock refiner having the improvement of claim 8, wherein said bearings havve inner races corotatable with the shaft and outer races in relatively nonrotary but axially slidable engagement with cylindrical surface of the quill, and said member engages said outer races.

12. A paper stock refiner having the improvement of claim 8, including a cover plate carried by said arm over said opening.

* * * * *

UNITED STATES PATENT AND TRADEMARK OFFICE

CERTIFICATE OF CORRECTION

PATENT NO. : 4,083,503

DATED : April 11, 1978

INVENTOR(S) : Robert P. Langdon

It is certified that error appears in the above-identified patent and that said Letters Patent are hereby corrected as shown below:

Column 6, line 27, change "rotor" to ---stator---.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*